US011447373B2

(12) United States Patent
Caldwell et al.

(10) Patent No.: US 11,447,373 B2
(45) Date of Patent: Sep. 20, 2022

(54) LIFT CAPACITY SYSTEM FOR LIFTING MACHINES

(71) Applicant: Caterpillar Inc., Peoria, IL (US)

(72) Inventors: Curtis J. Caldwell, Metamora, IL (US); Timothy E. Camacho, Morton, IL (US); Aaron J. Gnagey, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 455 days.

(21) Appl. No.: 16/585,582

(22) Filed: Sep. 27, 2019

(65) Prior Publication Data

US 2021/0094803 A1 Apr. 1, 2021

(51) Int. Cl.

| | |
|---|---|
| ***B66C 13/00*** | (2006.01) |
| ***B66C 13/46*** | (2006.01) |
| ***B66C 13/16*** | (2006.01) |
| ***B66C 23/76*** | (2006.01) |
| ***B66C 23/90*** | (2006.01) |
| ***B66C 23/18*** | (2006.01) |

(52) U.S. Cl.

CPC ..... *B66C 13/46* (2013.01); *B66C 13/16* (2013.01); *B66C 23/18* (2013.01); *B66C 23/76* (2013.01); *B66C 23/90* (2013.01); *B66C 2700/082* (2013.01)

(58) Field of Classification Search

CPC ..... B66C 13/08; B66C 13/085; B66C 13/16; B66C 13/44; B66C 13/46; B66C 15/065; B66C 23/18; B66C 23/46; B66C 23/66; B66C 23/76; B66C 23/905

See application file for complete search history.

(56) References Cited

U.S. PATENT DOCUMENTS

| | | | | |
|---|---|---|---|---|
| 5,160,055 | A | 11/1992 | Gray | |
| 7,912,612 | B2 | 3/2011 | Janardhan et al. | |
| 9,238,570 | B2 | 1/2016 | Schoonmaker et al. | |
| 9,902,596 | B2 | 2/2018 | Morrow et al. | |
| 10,138,094 | B2 | 11/2018 | Eberharter et al. | |
| 10,173,868 | B2 | 1/2019 | Nysse et al. | |
| 10,410,124 | B1 * | 9/2019 | Zhou | G06N 5/04 |
| 2004/0200644 | A1 * | 10/2004 | Paine | G01G 19/083 177/136 |
| 2019/0033158 | A1 | 1/2019 | Bonnet et al. | |

FOREIGN PATENT DOCUMENTS

| | | | | |
|---|---|---|---|---|
| CN | 101939246 A | * | 1/2011 | B66C 13/06 |
| GB | 2072343 B | | 9/1983 | |
| RU | 67080 U1 | * | 10/2007 | B66C 23/36 |
| WO | WO-2009103216 A1 | * | 8/2009 | B66C 23/36 |

* cited by examiner

*Primary Examiner* — Emmanuel M Marcelo

(74) *Attorney, Agent, or Firm* — Bookoff McAndrews, PLLC

(57) ABSTRACT

A lift machine includes a machine chassis, a boom extending from the machine chassis, and a connector extending from the boom for coupling to a load. The machine further includes a control system that determines a lift capacity of the machine based on a skew of the connector caused by the load.

19 Claims, 5 Drawing Sheets

LIFT CAPACITY SYSTEM FOR LIFTING MACHINES

TECHNICAL FIELD

The present disclosure relates generally to lifting machines, and more particularly to lift capacity systems for such machines.

BACKGROUND

Lifting machines, such as pipelayer machines are used for lifting and moving large objects into or above the ground. Such objects can include heavy lengths of conduit for pipelines. The installation of such conduits can be challenging. The desired locations of such pipelines can be some of the most remote areas on earth, and the terrain over which the pipeline must traverse is often some of the most rugged. The land may have significant elevational changes and varying types of ground. In order to install the conduit, the pipelayer machine must be able to traverse such terrain and be able to lift and accurately place loads often in excess of 200,000 pounds.

When installing the conduit, the pipelayer machine uses a boom on the side of the machine that can be controllably extended away from the machine over a range of angles with respect to the chassis of the machine. One or more cables may extend from a winch or other power source through a series of sheaves or pulleys and terminate in a grapple hook or other suitable terminus of the boom. The grapple hook can then be secured to the pipe in such a way that when the winch recoils, the pipe is lifted. The pipelayer machine is then navigated to a desired location and the boom is lowered to a desired location for accurate installation of the pipe, such as into a trench.

During operation, the pipelayer machine positions the weight of the conduit in cantilevered fashion away from the chassis, engine and undercarriage of the pipelayer. As the chassis, engine and undercarriage comprise the majority of the weight of a pipelayer, depending on the weight of the pipe being lifted and the length of the boom arm, the pipelayer can be subject to potential tipping and instability. Conversely, if the pipelayer is operated to conservatively avoid the capability of the machine, the ability of the pipelayer to access the desired installation location can be significantly limited.

In addition, current demands being placed on pipelayer machines require higher lifting capacities and boom lengths/angles. The pipelayer could in theory simply be made larger and heavier to satisfy these needs, but realistically the general footprint of the pipelayer is limited by cost, maneuverability, and transportation considerations. As stated above, pipelayers need to be operated in very remote and difficult locations. Pipelayer machines also have to be nimble enough to perform the job. Moreover, over-sizing the undercarriage and boom of the pipelayer will also increase manufacturing costs in terms of materials, and operating costs in terms of fuel.

U.S. Patent Application Publication No. 2019/0033158 A1 to Bonnet et. al. ("the '158 publication") discloses a load moment indicator system and method for a pipelayer machine. The system of the '158 publication uses a sensor array for determining the tipping stability of the pipelayer machine in real-time. The sensor array uses sensors that are all provided on the main body of the pipelayer machine. In particular, the sensor array may include a load pin, a luff accelerometer, a boom winch encoder, a vehicle accelerometer, and a hook winch encoder. While the '158 publication discloses a system that determines the tipping stability of a pipelayer in real-time, the system does not take into account all of the factors relevant to tipping stability. In view of this, there is a need for pipelayer machines to include lift capacity systems that accurately determine the maximum load that the pipelayer machine can accommodate without tipping.

The lift capacity system of the present disclosure may solve one or more of the problems set forth above and/or other problems in the art. The scope of the current disclosure, however, is defined by the attached claims, and not by the ability to solve any specific problem.

SUMMARY

In one aspect, a lift machine includes a machine chassis, a boom extending from the machine chassis, and a connector extending from the boom for coupling to a load. The machine further includes a control system that determines a lift capacity of the machine based on a skew of the connector caused by the load.

In another aspect, a method for determining a lift capacity of a lift machine is disclosed. The lift machine includes a chassis, a boom extending from the chassis, and a connector extending from the boom for coupling to a load. The method includes sensing information including: a fore, aft, and roll position of chassis, an angle of the boom, the load coupled to the connector, and a skew of the connector based on the load. The method further includes determining a lift capacity of the machine based at least on the sensed information.

In yet another aspect, a mobile pipelayer machine includes a machine chassis, a boom extending from the machine chassis, a movable counterweight extending from the machine chassis, and a connector extending from the boom for coupling to a load. The machine further includes a control system including a controller that receives information indicative of a fore, aft, and roll position of chassis, a position of the counterweight, an angle of the boom, the load coupled to the connector, a skew of the connector based on the load, and wherein the control system determines a real-time lift capacity of the machine based at least on the information.

DETAILED DESCRIPTION

Both the foregoing general description and the following detailed description are exemplary and explanatory only and are not restrictive of the features, as claimed. As used herein, the terms "comprises," "comprising," "having," including," or other variations thereof, are intended to cover a non-exclusive inclusion such that a process, method, article, or apparatus that comprises a list of elements does not include only those elements, but may include other elements not expressly listed or inherent to such a process, method, article, or apparatus. Moreover, in this disclosure, relative terms, such as, for example, "about," substantially," and "approximately" are used to indicate a possible variation of ±10% in the stated value.

Figure 1:
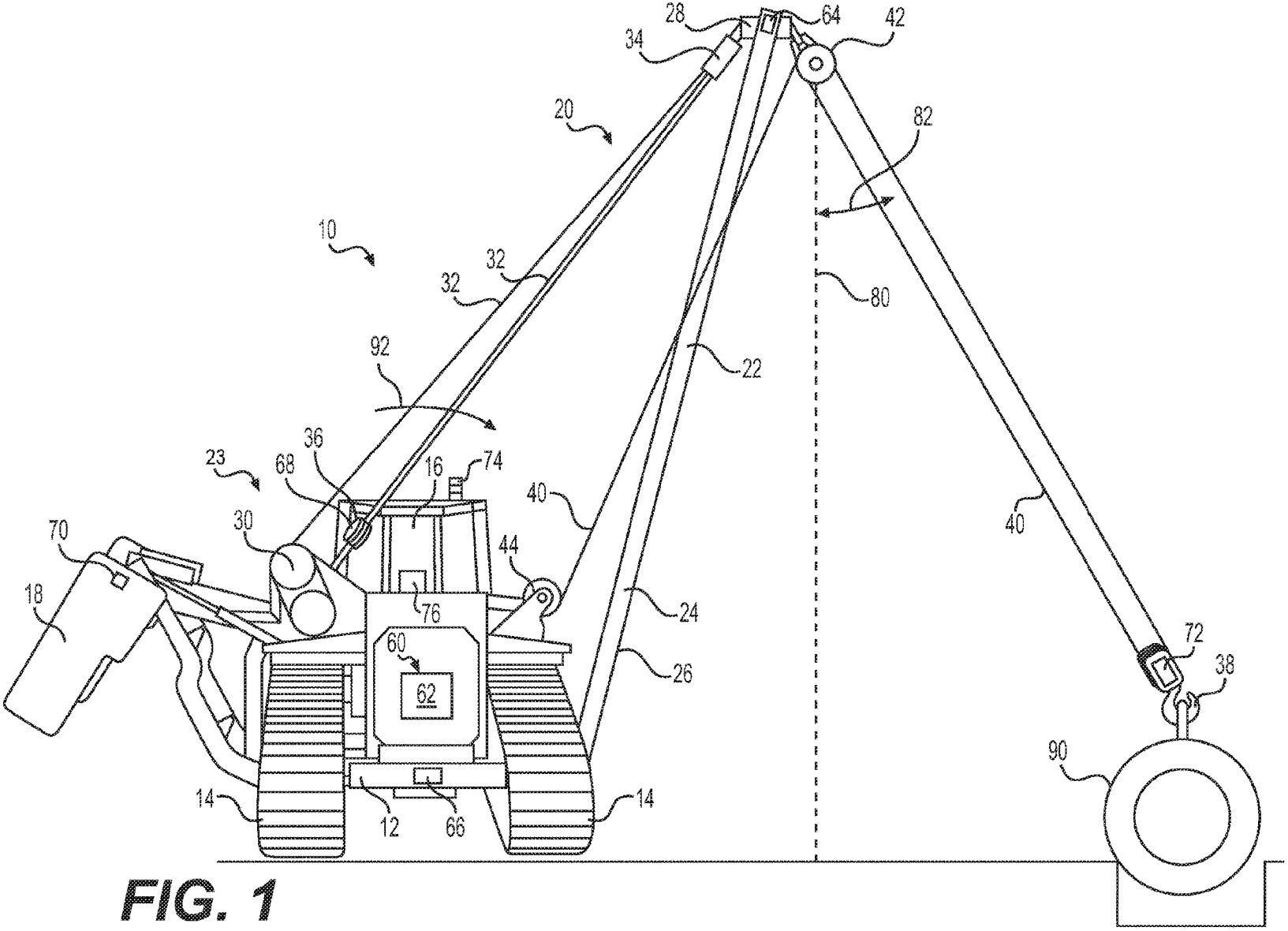
FIG. 1 shows a front view of an exemplary lifting machine having a crane assembly in accordance with the present disclosure.

FIG. 1 illustrates a lifting machine 10 having a crane assembly 20. Throughout this disclosure, lifting machine 10 will be described with reference to a mobile pipelayer machine 10, however it is understood that machine 10 may be any type of lifting machine having a crane assembly 20. Pipelayer machine 10 may include a chassis 12, a pair of drive tracks 14, a movable counterweight 18, a power source such as an internal combustion engine (not shown), and an operator's cab 16. As will be described in more detail below, pipelayer 10 may also include control system 60 including a controller 62 coupled to a plurality of sensors 64-72, an indicator 74, and a display 76 located in the operator's cab 16.

Figure 2:
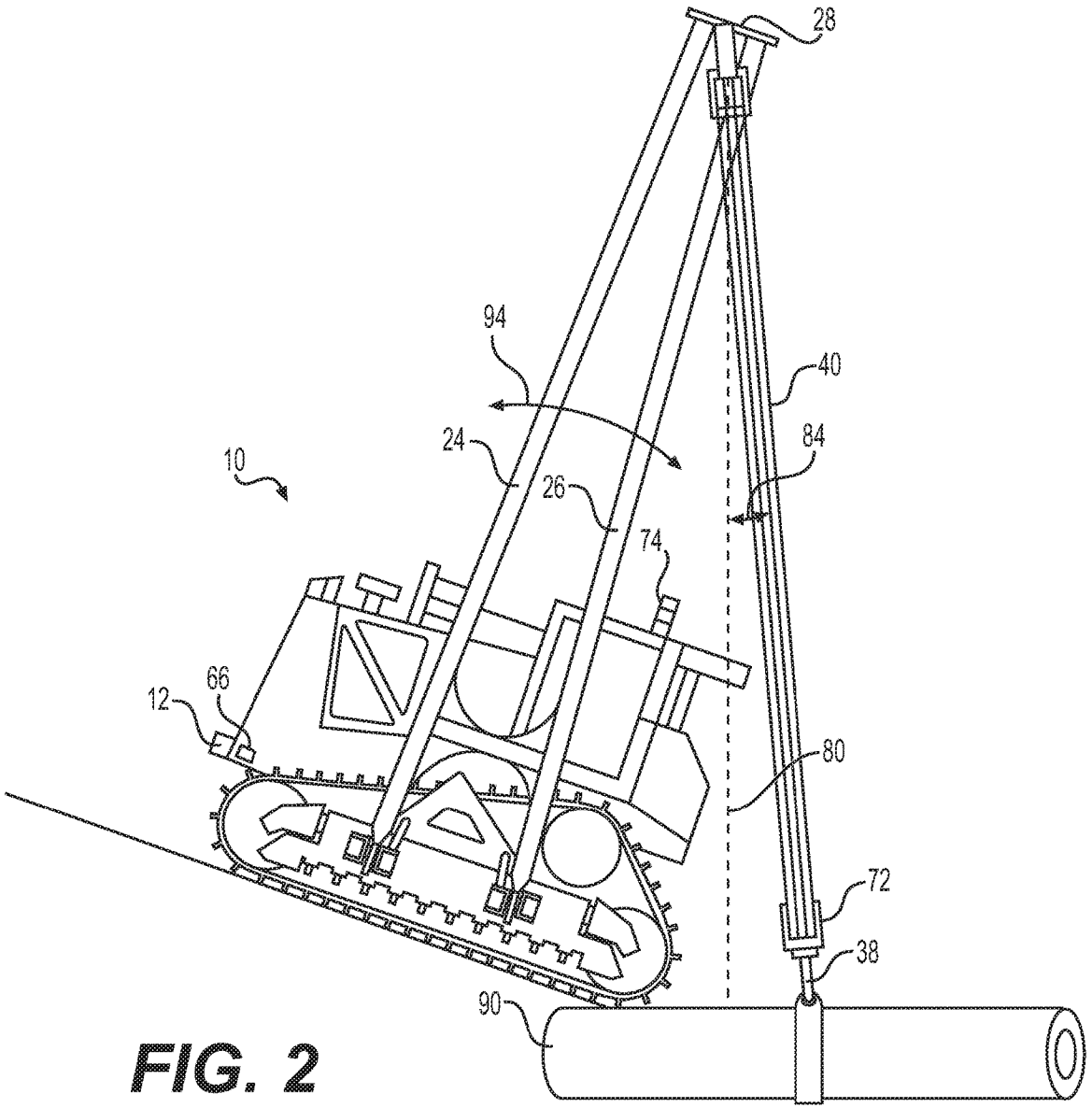
FIG. 2 shows a side view of the lifting machine of FIG. 1.

As shown in FIGS. 1 and 2, crane assembly 20 may include a boom 22, and a winch system 23. The boom 22 may include first and second legs 24, 26 (FIG. 2) independently hinged to the chassis 12 at one end, and extending to a joined boom tip 28. Winch system 23 may include winch 30 and a first set of lifting cables 32 extending from winch 30 through a series of pulleys or sheaves 34, 36. The crane assembly 20 may further include a grapple hook 38 or other terminating connector coupled to the boom tip 28 through a second set of lifting cables 40, pulleys or sheaves 42, 44, and winch 30.

Figure 3:
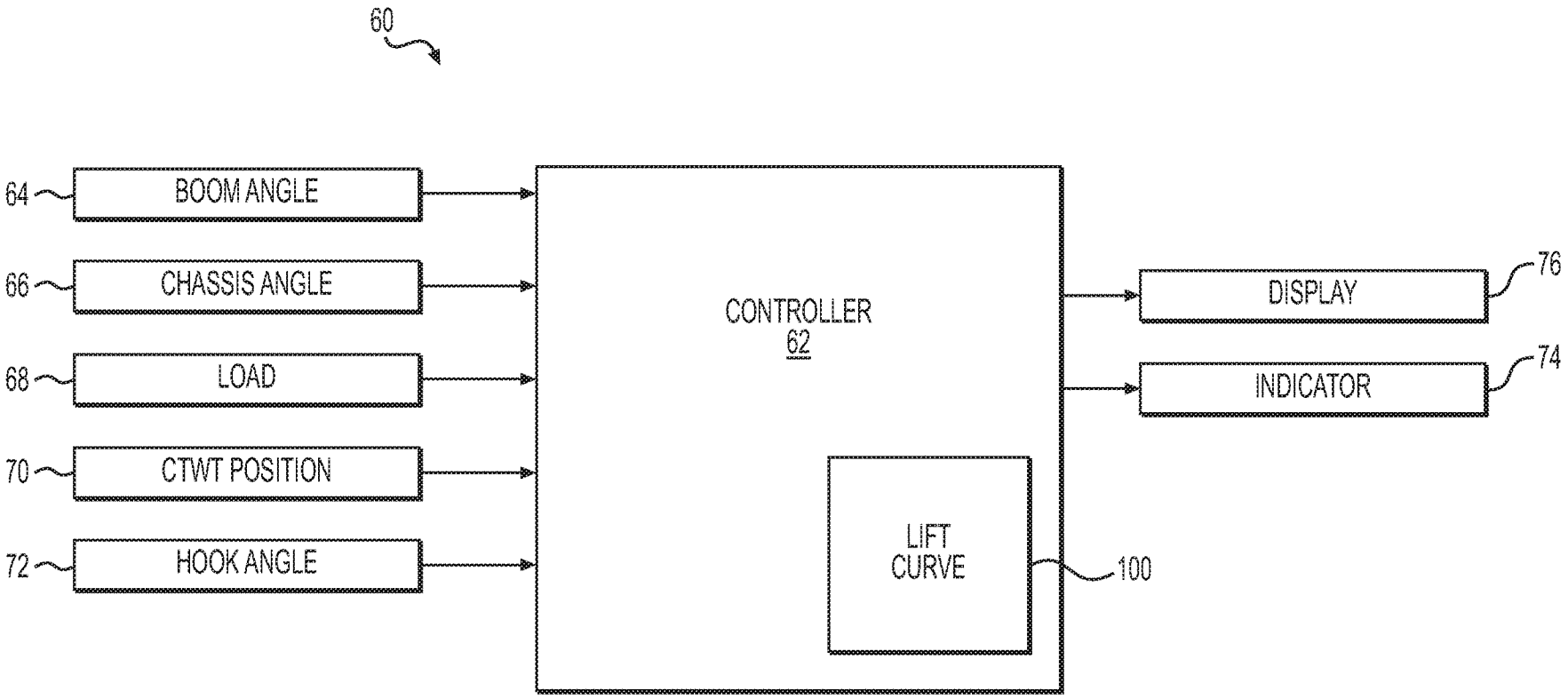
FIG. 3 shows an exemplary control system of the lifting machine of FIG. 1.

With reference to FIGS. 1 and 3, control system 60 may include a controller 62. Controller 62 may include any appropriate hardware, software, firmware, etc. to carry out the methods described in this disclosure, including the method of FIG. 5. Controller 62 may include one or more processors, memory, communication systems, and/or other appropriate hardware. The processors may be, for example, a single or multi-core processor, a digital signal processor, microcontroller, a general purpose central processing unit (CPU), and/or other conventional processor or processing/controlling circuit or controller. The memory may include, for example, read-only memory (ROM), random access memory (RAM), flash or other removable memory, or any other appropriate and conventional memory. The communication systems used in the components of the control system 60 may include, for example, any conventional wired and/or wireless communication systems such as Ethernet, Bluetooth, and/or wireless local area network (WLAN) type systems. The communication system of controller 62 may include communication to and from, for example, sensors 64-72, indicator 74, and display 76. Further, controller 62 may have stored therein a lift curve 100, as will be described in more detail below.

Sensors 64-72 may be sensors arranged to provide controller 62 with data regarding the lift capacity of pipelayer machine 10. For example, sensor 64 may be a boom angle sensor to provide data corresponding to an angle of boom 22 with respect to chassis 12. Boom angle sensor 64 may be used by control system 60 to determine, or as a value indicative of, the distance of overhang of boom 22 away from chassis 12 of pipelayer machine 10. Boom angle sensor 64 may be located at boom tip 28, or at other appropriate positions on pipelayer machine 10. Sensor 66 may be a chassis angle sensor providing data regarding corresponding to the fore or aft pitch (94 FIG. 2) and roll 92 (FIG. 1) of the pipelayer machine 10. The chassis angle sensor 66 maybe located on the chassis 12, or at other appropriate positions on pipelayer machine 10. Sensor 68 may be a load sensor providing data regarding the load connected to grapple hook 38. Load sensor 68 may be located at pulley or sheave 36 of winch system 23, or at other appropriate positions on pipelayer machine 10. Sensor 70 may be a counterweight position sensor providing data indicative of the location or extension of counterweight 18. Counterweight position sensor 70 may be located on counterweight 18, or at other appropriate position on pipelayer machine 10. Sensor 72 may be a hook position sensor providing data regarding the angular location of the grapple hook 38. For example, hook angle sensor 72 may provide an angular position of grapple hook 38 with respect to a vertical reference line or "plum line" position 80 of grapple hook 38—corresponding to a position of grapple hook 38 and associated lifting cables 40 extending from pulley or sheave 42 extending vertically along the force of gravity. See FIGS. 1 and 2. As show in FIG. 1, grapple hook 38 may be skewed in the roll direction by an angle 82 extending away from a side of pipelayer machine 10, or skewed in a pitch direction at an angle 84 shown in FIG. 2 extending fore or aft with respect to the plum line position 80. Hook angle sensor 72 may be located on grapple hook 38, or at other appropriate positions on pipelayer machine 10. Sensors 64-72 may form a sensing system and may include any standard type of sensor, such as an inertial measurement unit (IMU), an angle sensor, a load pin type sensor, a camera-based sensor, or any other appropriate type of sensor to provide the required data.

Referring to FIGS. 1 and 3, display 76 may be any type of display, screen, information panel, etc. for receiving information from controller 62 and providing information to an operator or supervisor of pipelayer machine 10. Display 76 may be located in operator's cab 16, and/or be located at a remote location. As will be described in more detail below, display 76 may provide information relating to, for example, the lift capacity of pipelayer machine 10 received from control system 60. Indicator 74 may be any type of indicator for proving information to an operator of pipelayer machine 10, or personnel located near pipelayer machine 10. For example, as shown in FIG. 1, indicator 74 may be a series of indicator lights that provide visual lift capacity information, such as green, yellow, and red lights that provide a warning of a potential tipping of pipelayer machine based on exceeding a lifting limit as determined by control system 60. While indicator 74 is shown as a visual indicator on the operator's cab, it is understood that the indicator could be alternatively or additionally be an audible indicator, and could be located at any appropriate location on pipelayer machine 10.

INDUSTRIAL APPLICABILITY

The disclosed aspects of the present disclosure may be used in any lifting machine that has the potential to tip based on dynamic loading. For example, the present disclosure may be used by a pipelayer machine to provide an operator, supervisor or other personnel with real-time lifting capacity information of the pipelayer machine 10.

Figure 5:
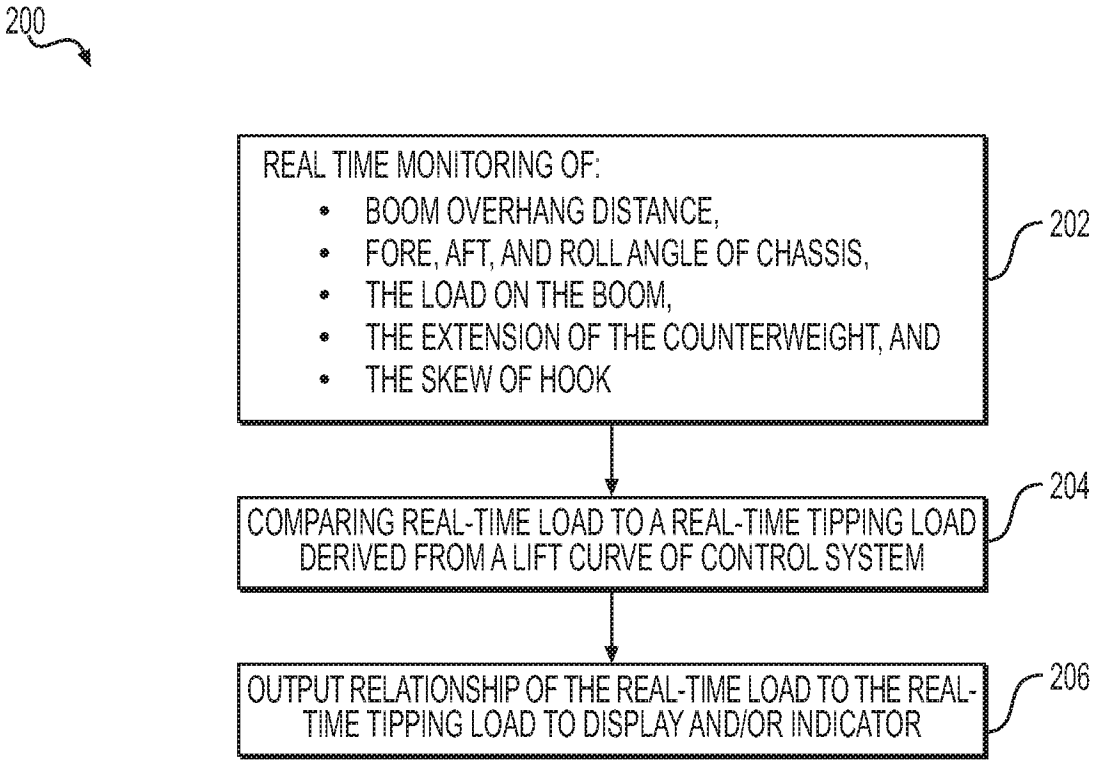
FIG. 5 is a method of operating the exemplary lifting machine of FIG. 1.

Referring to FIGS. 3 and 5, during operation of pipelayer machine 10, control system 60 monitors the lifting capacity of the pipelayer machine 10 based on data from sensors 64-72 and a lift curve 100. Outputs of real-time lifting capacity status may be provided by controller 62 to display 76 and/or indicator 74.

Figure 4:
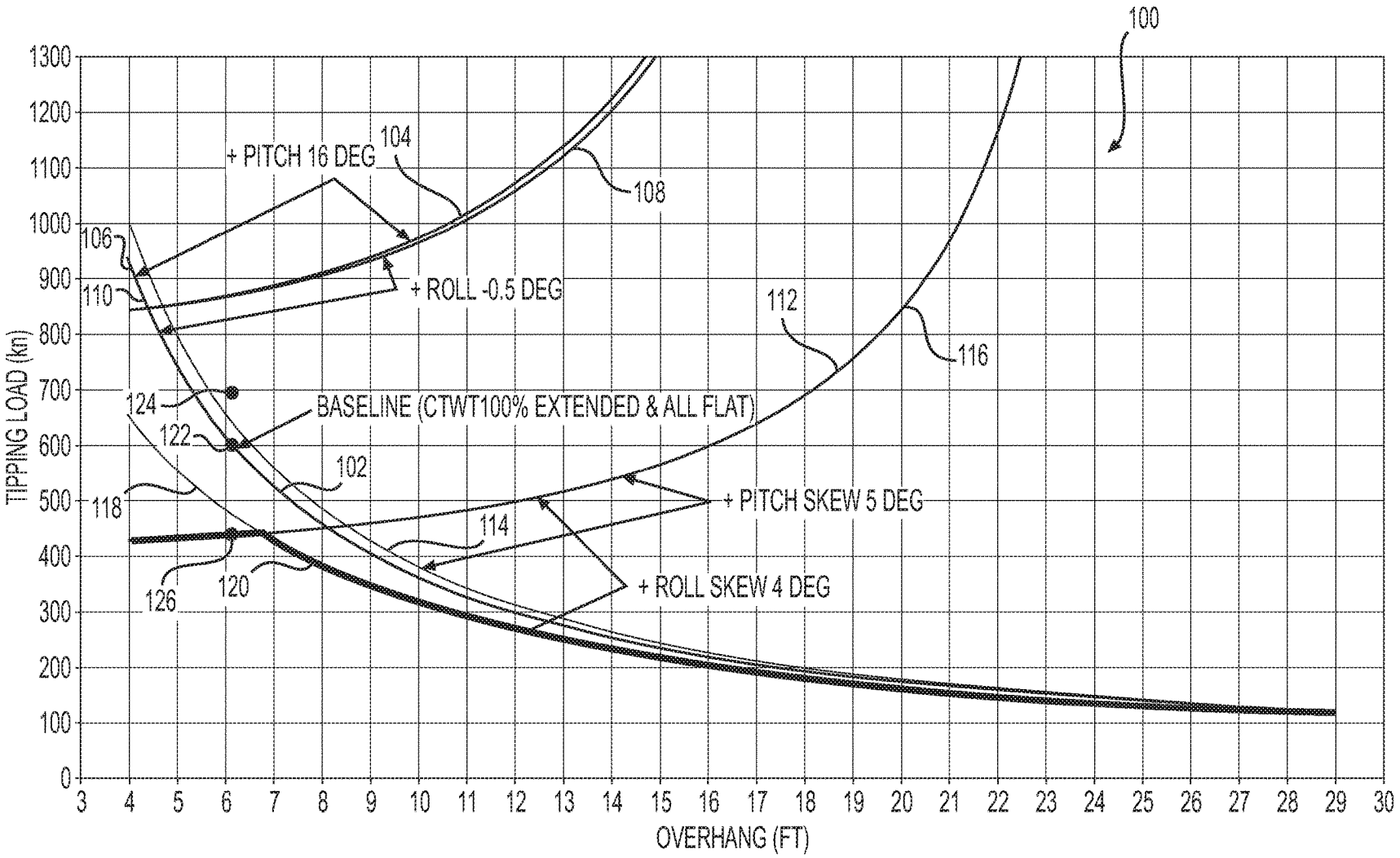
FIG. 4 shows an exemplary lift curve associated with a control system of FIG. 3.

An exemplary lift curve 100 of the present disclosure is shown in FIG. 4 and may be stored in controller 62. Lift curve 100 may include one or more maps, tables, charts, etc. that identify a lifting limit of the pipelayer machine 10 based on various sensed parameters, such as information from one or more of sensors 64-72. Lift curve 100 may be compiled or formed based on experimental, empirical, or calculated data and may be based on the physical attributes of pipelayer machine 10. As shown in FIG. 4, lift curve 100 may include an x-axis providing a tipping load (in kilonewtons) of the pipelayer machine 10, and a y-axis corresponds to an overhang distance or extension (in feet) of the boom 22 away from the chassis 12 of the pipelayer machine 10. The tipping load corresponds to a load on boom 22 that will tip the pipelayer machine 10 in either a fore, aft, or roll direction.

Lift curve 100 may include various tipping load lines 102-120 that identify the relationship of tipping load to the sensed information from sensors 64-72, e.g. boom overhang distance (via boom angle sensor 64), fore, aft, and roll angle of chassis 12 (via chassis angle sensor 66), the load on the boom 22, for example, from pipe 90 (via load sensor 68), the extension of counterweight 18 (counterweight position sensor 70), and the skew or angular position of grapple hook 38 (via hook angle sensor 72). For example, tipping load line 102 may correspond to counterweight 18 fully extended to its maximum position away from chassis 12 (i.e., CTWT 100%), and the pipelayer machine on flat ground, i.e., no fore, aft, or roll inclination measured from chassis angle sensor 66, and no skew of the grapple hook 38 measured by hook angle sensor 72. Thus, under these conditions, baseline tipping load line 102 provides a point 122 identifying a tipping load of 600 kilonewtons at an overhang distance of just over 6 feet. Thus, if boom angle sensor 64 indicates an overhang distance of just over 6 feet, and the load sensor 68 indicates a load on the boom of greater than 600 kilonewtons, e.g., 700 kilonewtons (point 124 in FIG. 4), then the pipelayer machine 10 has exceeded it lifting capacity and is at risk of tipping. This real-time lifting capacity status from lift curve 100 and controller 62 may be provided on a real-time basis to display 76 and indicator 74.

The tipping load lines 104-110 may also take into account the fore, aft, and roll angle of the pipelayer machine 10. Such angular orientations of pipelayer machine 10 may be indicative of the pipelayer machine 10 operating on an incline in one or more of the fore pitch, aft pitch, and roll directions. For example, lift curve 100 of FIG. 4 may include a pair of tipping load lines 104, 106 that correspond to pipelayer machine 10 operating with a fore pitch (i.e., the machine pointing downhill) at an angle of 16 degrees. Tipping load line 104 indicates the tipping load in a pitch direction, and tipping load line 106 indicates the tipping load in a roll direction. It is noted that tipping load line 106 is the same as the baseline tipping load line 102, indicating that the 16 degrees of fore pitch of the machine 10 does not affect the roll tipping load of the pipelayer machine 10. In this condition, the composite tipping load line of tipping load lines 104 and 106 (i.e. the minimum tipping load when combining both tipping load lines 104 and 106) corresponds to tipping load line 106 clipped at the top by the tipping load line 104.

Adding a roll angle to the pipelayer machine 10 of negative 0.5 degrees (away from the ditch) in addition to the 16 degrees of fore pitch provides for tipping load lines 108 and 110. Note that tipping load line 110 is the same as baseline tipping load line 102 and the tipping load line 106 of 16 degrees of fore pitch. The tipping load line 108 based on the −0.5 degrees of roll show a slight detrimental effect on the pitch tipping loads, but no effect the composite tipping load line associated with the 16 degrees of fore pitch. The −0.5 degrees of roll provides for the same clipping effect of baseline load line 102 as the 16 degrees of fore pitch alone.

As noted above, lift curve 100 may also take into account the skew of grapple hook 38 with respect to a plum-line position 80. The skew of grapple hook 38 can be a roll skew angle 82 (FIG. 1) or a pitch skew angle 84 (FIG. 2), and the angles can be obtained by hook angle sensor 72. Referring to lift curve 100 of FIG. 4, tipping load lines 112 and 114 correspond to pipelayer machine 10 with grapple hook 38 positioned at a pitch skew angle of 5 degrees (in addition to a machine fore pitch of 16 degrees and −0.5 degrees of machine roll as discussed above). The tipping load lines 112, 114 based on the 5 degrees of pitch skew of grapple hook 38 show a significant detrimental effect on the pitch tipping loads of the pipelayer machine 10 as indicated by the lower tipping load line 112 compared to tipping load line 108. However, the 5 degrees of pitch skew of grapple hook 38 slightly improves the roll tipping load as indicated by the slight shifting to the right of tipping load line 114 compared to tipping load line 110. Thus, the composite tipping load line of 112 and 114 has a significant clipping affect of the composite tipping load line of tipping load lines 108 and 110.

Finally, adding an additional roll skew of 4 degrees to grapple hook 38 (in addition to the machine pitch, machine roll, and hook roll skew discussed above) provides for tipping load lines 116 and 118. Note that tipping load line 116 is the same as tipping load line 112. The 4 degrees of roll skew of grapple hook 38 has a detrimental effect on the roll tipping load of pipelayer machine 10, as indicated by the shifting to the left of tipping load line 118 compared to tipping load line 114. The composite tipping load line of tipping load lines 116 and 118 is shown in bolded line 120 of FIG. 4, and corresponds to the tipping load line when the pipelayer machine has a machine pitch of 16 degrees (pointing downhill) a machine roll of −0.5 degrees (away from the ditch), and a grapple hook 38 supporting pipe 90 at a pitch skew of 5 degrees and a roll skew of 4 degrees. As indicated by composite tipping load line 120, the skew of grapple hook 38 has a significant affect on the tipping load of the pipelayer machine 10. For example, point 122 on load curve 100 indicates a tipping load of 600 kilonewtons at slightly over 6 feet of overhang when the pipelayer machine 10 has the counterweight fully extended, a machine pitch of 16 degrees (pointing downhill), and a machine roll of −0.5 degrees (away from the ditch). By adding a hook pitch skew of 5 degrees and a hook roll skew of 4 degrees, the tipping load at slightly over 6 feet of overhang moves to point 126, corresponding to a lowering of the tipping load by approximately 170 kilonewtons to a value of 430 kilonewtons.

FIG. 5 provides a method 200 of operation of a lifting machine in accordance with the present disclosure. Method 200 includes real-time monitoring of information from sensors 64-72, e.g. a boom overhang distance (via boom angle sensor 64), fore, aft, and roll angle of chassis 12 (via chassis angle sensor 66), the load on the boom 22, for example, from pipe 90 (via load sensor 68), the extension of counterweight 18 (counterweight position sensor 70), and the skew or angular position of grapple hook 38 (via hook angle sensor 72) (step 202). The monitored information is provided to controller 62. The method further includes comparing the real-time load on the grapple hook 38 of the machine to a tipping load derived from a lift curve 100 of control system 60 as a function of the boom overhang distance (via boom angle sensor 64), fore, aft, and roll angle of chassis 12 (via chassis angle sensor 66), the load on the boom 22, (via load sensor 68), the extension of counterweight 18 (counterweight position sensor 70), and the skew or angular position of grapple hook 38 (via hook angle sensor 72) (step 204). In step 206, the relationship of the real-time load to the real-time tipping load is output to an operator, supervisor, or other personnel via display 76 and/or indicator 74. The information provided to display 76 and/or indicator 74 may take different forms, such as an output of remaining lift capacity of the machine (as an absolute value, numerical comparison, or percentage of capacity remaining), or may take the form of a warning (visual and/or audible) when real-time loads approach the real-time tipping load.

The lift capacity system of the present disclosure may facilitate a more accurate tracking of tipping loads, may facilitate a safe operation of the pipelayer machine 10 by helping to avoid tipping, and/or facilitates a more efficient operation of the pipelayer machine 10 by allowing the machine to operate closer to its maximum capacity.

It will be apparent to those skilled in the art that various modifications and variations can be made to the disclosed system without departing from the scope of the disclosure. Other embodiments of the system will be apparent to those skilled in the art from consideration of the specification and practice of the lift capacity system disclosed herein. It is intended that the specification and examples be considered as exemplary only, with a true scope of the disclosure being indicated by the following claims and their equivalents.

What is claimed is:

1. A lift machine, comprising:
- a machine chassis;
- a boom extending from the machine chassis;
- a connector extending from the boom for coupling to a load; and
- a control system that determines a lift capacity of the machine based on a skew of the connector caused by the load, wherein the skew of the connector is a position fore, aft, or roll with respect to a plum line associated with the connector.

2. The lift machine of claim 1, wherein the lift capacity is further based on a position of a counterweight of the lift machine.

3. The lift machine of claim 2, wherein the lift capacity is further based on a first fore, aft, and roll position of the chassis.

4. The lift machine of claim 3, wherein the lift capacity is further based on an overhang of the boom and the load.

5. The lift machine of claim 1, wherein the lift machine is a pipelayer machine.

6. The lift machine of claim 5, further including a sensing system for determining the skew of the connector.

7. The lift machine of claim 6, wherein the sensing system includes an IMU sensor, a camera-based sensor, or an angular sensor.

8. The lift machine of claim 5, further including a display on the machine that displays the lift capacity of the machine.

9. The lift machine of claim 5, wherein the lift capacity corresponds to a lifting capacity of the machine before the machine begins to tip.

10. A method for determining a lift capacity of a lift machine, the lift machine including a chassis, a boom extending from the chassis, and a connector extending from the boom for coupling to a load, the method comprising:
- sensing information including
  - a fore, aft, and roll position of the chassis;
  - an angle of the boom;
  - the load coupled to the connector;
  - a skew of the connector based on the load; and
- determining a lift capacity of the machine based at least on the sensed information.

11. The method of claim 10, wherein the sensing information further includes sensing a position of a movable counterweight of the lift machine.

12. The method of claim 11, wherein the skew of the connector is based on a position of the connector with respect to a plum line of the connector.

13. The method of claim 12, further including outputting an indication of the determined lift capacity on a display of the lift machine.

14. The method of claim 13, wherein the lift machine is a mobile pipe layer machine.

15. The method of claim 14, wherein the skew of the connector includes a pitch skew and a roll skew.

16. A mobile pipelayer machine, comprising:
- a machine chassis;
- a boom extending from the machine chassis;
- a movable counterweight extending from the machine chassis;
- a connector extending from the boom for coupling to a load; and
- a control system including a controller that receives information indicative of
  - a fore, aft, and roll position of the chassis;
  - a position of the counterweight;
  - an angle of the boom;
  - the load coupled to the connector;
  - a skew of the connector based on the load; and
- wherein the control system determines a real-time lift capacity of the machine based at least on the information.

17. The mobile pipe layer machine of claim 16, further comprising a display outputting an indication of the determined lift capacity.

18. The mobile pipe layer machine of claim 16, further including a sensing system that determines the information.

19. The mobile pipe layer machine of claim 18, wherein the sensing system includes a sensor that determines a pitch and roll skew of the connector with respect to a plum line of the connector.

* * * * *